US009738359B2

(12) United States Patent
Falkman

(10) Patent No.: US 9,738,359 B2
(45) Date of Patent: Aug. 22, 2017

(54) NAVAL RESCUE VESSEL

(75) Inventor: Fredrik Falkman, Göthenburg (SE)

(73) Assignee: SAFE AT SEA AKTIEBOLAG, Kungalv (SE)

( * ) Notice: Subject to any disclaimer, the term of this patent is extended or adjusted under 35 U.S.C. 154(b) by 2372 days.

(21) Appl. No.: 12/596,675

(22) PCT Filed: Apr. 25, 2007

(86) PCT No.: PCT/SE2007/050271

§ 371 (c)(1),
(2), (4) Date: Jul. 6, 2011

(87) PCT Pub. No.: WO2008/133557

PCT Pub. Date: Nov. 6, 2008

(65) Prior Publication Data

US 2011/0253028 A1 Oct. 20, 2011

(51) Int. Cl.

| | |
|---|---|
| ***B63B 3/08*** | (2006.01) |
| ***B63B 7/00*** | (2006.01) |
| ***B63C 9/02*** | (2006.01) |
| ***B63H 11/00*** | (2006.01) |
| ***B63B 7/08*** | (2006.01) |
| ***B63H 11/02*** | (2006.01) |
| *B63B 7/06* | (2006.01) |

(52) U.S. Cl.
CPC ..... *B63C 9/02* (2013.01); *B63B 7/00* (2013.01); *B63B 7/06* (2013.01); *B63B 7/082* (2013.01); *B63H 11/02* (2013.01); *B63B 2007/065* (2013.01)

(58) Field of Classification Search
CPC ..... B63B 2007/006; B63B 7/02; B63B 7/04; B63B 7/06; B63B 7/082; B63B 2007/065; B63C 9/02; B63H 11/02
USPC ..... 114/248, 258, 259, 345, 352; 440/38
See application file for complete search history.

(56) References Cited

U.S. PATENT DOCUMENTS

| | | | | |
|---|---|---|---|---|
| 4,694,770 A * | 9/1987 | Kitner et al. | ..... | 114/123 |
| 4,811,682 A * | 3/1989 | Hwang et al. | ..... | 114/345 |
| 4,942,838 A * | 7/1990 | Boyer et al. | ..... | 114/345 |

(Continued)

FOREIGN PATENT DOCUMENTS

| | | |
|---|---|---|
| DE | 3429990 A1 | 1/1985 |
| DE | 20107120 U1 | 11/2001 |

(Continued)

OTHER PUBLICATIONS

European Supplementary Search Report (for corresponding EP application) completed May 13, 2011.

(Continued)

*Primary Examiner* — Ajay Vasudeva
(74) *Attorney, Agent, or Firm* — Jeffrey S. Melcher; Manelli Selter PLLC

(57) ABSTRACT

This invention relates to a naval rescue vessel, comprising a propulsion unit (1) powered by a water jet and a hull unit (200), wherein said hull unit is at least partly flexible and wherein said propulsion unit (100) is arranged to form a rigid unit, and wherein the two units (100, 200) are interconnected to form a naval rescue vessel intended to be handled/maneuvered by a single rescuer, wherein the interconnection (130, 205) between the two units (100, 200) is arranged to provide a releasable connection of the units.

9 Claims, 8 Drawing Sheets

(56) References Cited

U.S. PATENT DOCUMENTS

| | | | | | |
|---|---|---|---|---|---|
| 5,184,564 | A | * | 2/1993 | Robbins et al. | 114/345 |
| 5,301,630 | A | | 4/1994 | Genovese | |
| 5,354,222 | A | | 10/1994 | Elias | |
| 5,356,319 | A | * | 10/1994 | Parker | 440/38 |
| 5,385,111 | A | * | 1/1995 | Schulze | 114/345 |
| 5,746,150 | A | * | 5/1998 | Beaulac et al. | 114/248 |
| 5,848,921 | A | | 12/1998 | Mochida | |
| 6,135,047 | A | * | 10/2000 | Miller | 114/343 |
| 2005/0208849 | A1 | | 9/2005 | Ferrara | |

FOREIGN PATENT DOCUMENTS

| | | | | | |
|---|---|---|---|---|---|
| FR | 2767777 | A1 | | 3/1999 | |
| FR | 2858293 | A1 | | 2/2005 | |
| GB | 2032871 | A | * | 5/1980 | B63H 21/30 |
| GB | 2135940 | A | | 9/1984 | |
| JP | 62096193 | A | | 5/1987 | |

OTHER PUBLICATIONS

Written Opinion and International Search Report issued in parent PCT Application.

* cited by examiner

NAVAL RESCUE VESSEL

TECHNICAL FIELD

This invention relates to a naval rescue vessel, comprising a propulsion unit powered by a water jet and a hull unit, wherein said hull unit is at least partly flexible and wherein said propulsion unit is arranged to form a rigid unit, and wherein the two units are interconnected to form a naval rescue vessel intended to be handled/maneuvered by a single rescuer.

BACKGROUND AND PRIOR ART

Numerous different kind of naval rescue vessels are known for the purpose of rescuing people from drowning. For instance there exist numerous different kind of rescue boats of many different designs, using some kind of conventional propulsion. A general disadvantage with traditional boats is that they are relatively wide/large applying difficulty in coming close to the individual in need and/or difficulty in getting the individual on to the boat. Smaller naval rescue vessels do exist but they all have some kind of inferior stability, inferior loadability, inferior controllability and/or inferior propulsion power/power capability. It has been suggested to use a water scooter (small water jet vessel) to in a modified manner to create naval rescue vessel that could better fulfil existing needs, but up to now no such design has been made available.

SUMMARY OF THE INVENTION

It is an object of the invention to provide a design of a naval rescue vessel that may combine the advantages concerning versatility regarding a water scooter with design features suited for rescuing individuals in emergency situations in water, e.g. from drowning, which in accordance with the solution defined in the appended claims provides drastic synergetic results.

Thanks to the invention there is presented a new naval rescue vessel providing a great number of important advantages regarding saving PIW (person in water), e.g.:

- separate hull unit that may easily be exchanged, e.g. due to wear or damage,
- a design that allows for integrated portions providing a fender function,
- easy snap-in interconnection concept, which "automatically" provides exact positioning,
- a design that facilitates self-bailing between the two units,
- a rescue vessel that may easily be transported by means of helicopter, also at very high speeds,
- a design that allows to be toed at high speed,
- a design that may withstand tough conditions, e.g. to run ashore, that may lift the vessel to ride on top of big waves, that can withstand hard hits (e.g. touching a rock), etc.

Further advantages regarding preferred features of the invention will be presented in connection with the description of the preferred embodiment below.

BRIEF DESCRIPTION OF DRAWINGS

In the following the invention will be described more in detail with reference to the enclosed drawings, wherein.

DETAILED DESCRIPTION

Figure 1:
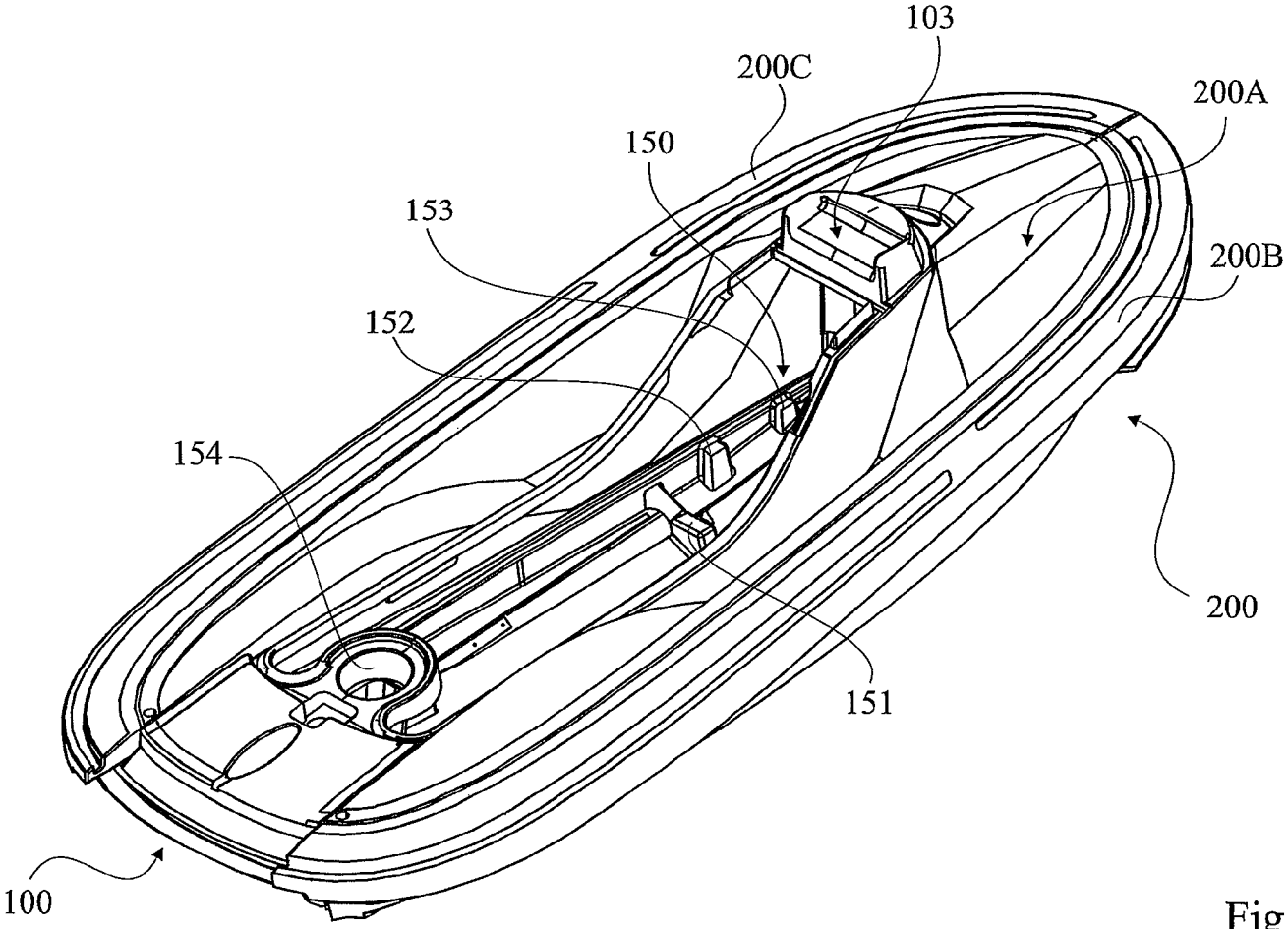
FIG. 1 shows a perspective view from above and behind of a vessel of a preferred embodiment according to the invention, having some of the upper portions cut away.

In FIG. 1 there is shown a perspective view from above and behind of essential portions of a hull unit 200 and a propulsion unit 100, in an assembled mode of the invention. The units 100, 200 are interlocked to form a naval rescue vessel. In the propulsion unit 100, presented with the top portion cut away, there is an inner space 150 for a water jet propulsion unit (not shown). The bottom of the propulsion unit 100 is arranged with numerous support devices, e.g. 151, 152, 153, onto which the propulsion unit is securely fixed. At the front of the propulsion unit 100 there is a drivers area 103, onto which, and in proximity to which, necessary control devices for propulsion of the vessel 100, 200 are/will be attached (not shown). The driver/rescuer will have his feet onto foot rest areas 202 formed in the hull unit 200. Adjacent the rear end of the propulsion unit 100 there is an opening 154 facilitate easy cleaning of the water jet (not shown). Preferably a water jet propulsion, a steering mechanism, control devices, etc. are used that exist for other water scooters, to take advantage of cost efficiency resulting from large scale production.

The hull unit 200 comprises a central portion 200A having a side/fender-portion 200B, 200C attached thereto on each side. All portions 200A, 200B, 200C of the hull unit 200 are produced in a flexible and resilient material, preferably polyethylene, and in such a manner that each portion 200A, 200B, 200C forms a sealed hollow inner space, preferably mainly (or indeed totally) filled with air. The sealed volume of all three units 200A-200C amount to about 800 $dm^3$, preferably in the range 500-1000 $dm^3$ providing extra safe buoyancy, since the three portions are sealed individually. Because each portion is produced in a resilient polymer, e.g. polyethylene, it provides extra safety, due to the fact that such a material will not be punctured even if hit by hard objects. Further, such a material is easily repaired by the use of conventional methods. Especially considering that the three different portions are individually sealed extra safety is provided since even if one of the portions would be punctured the remaining two would still provide sufficient buoyancy to enable safe manoeuvring and propulsion of the water scooter. It is understood that depending on the purpose and need of the vessel the total buoyancy needed may vary. Preferably the total buoyancy will be in the range of 1000 dm-1800 $dm^3$, more preferred 1200 dm-1600 $dm^3$. The amount of buoyancy is preferably divided among the three portions in such a manner that the side portions 200B, 200C are equally sized and in total would amount to about 10-40% of the total volume, preferably 20%-30%. Moreover the buoyancy is divided in the hull portion 200 in such a manner that the front will have a large amount of buoyancy, to give the vessel the ability to "ride on top of waves". The remaining volume is located in the central portion 200A. As mentioned a preferred kind of material to be used is a tough kind of polymer (such as polyethylene), which is preferably also weldable, due to the fact that preferably the side portions 200B, 200C are welded onto the central portion 200A to thereby safely and securely fix them. Preferably each portion is rotation moulded. The thickness of the enclosing barrier layer is thereby easily adapted by the amount of polymer that is supplied into the mould. Preferably the thickness of the sealing encasing is in the range of 2-10 mm, preferably 4-7 mm. In a preferred embodiment the thickness of the central portion 200A is larger than the thickness of the side portions 200B, 200C, e.g. about 7 mm in the central portion 200A and about 4 mm in the side portions 200B, 200C.

Figure 2:
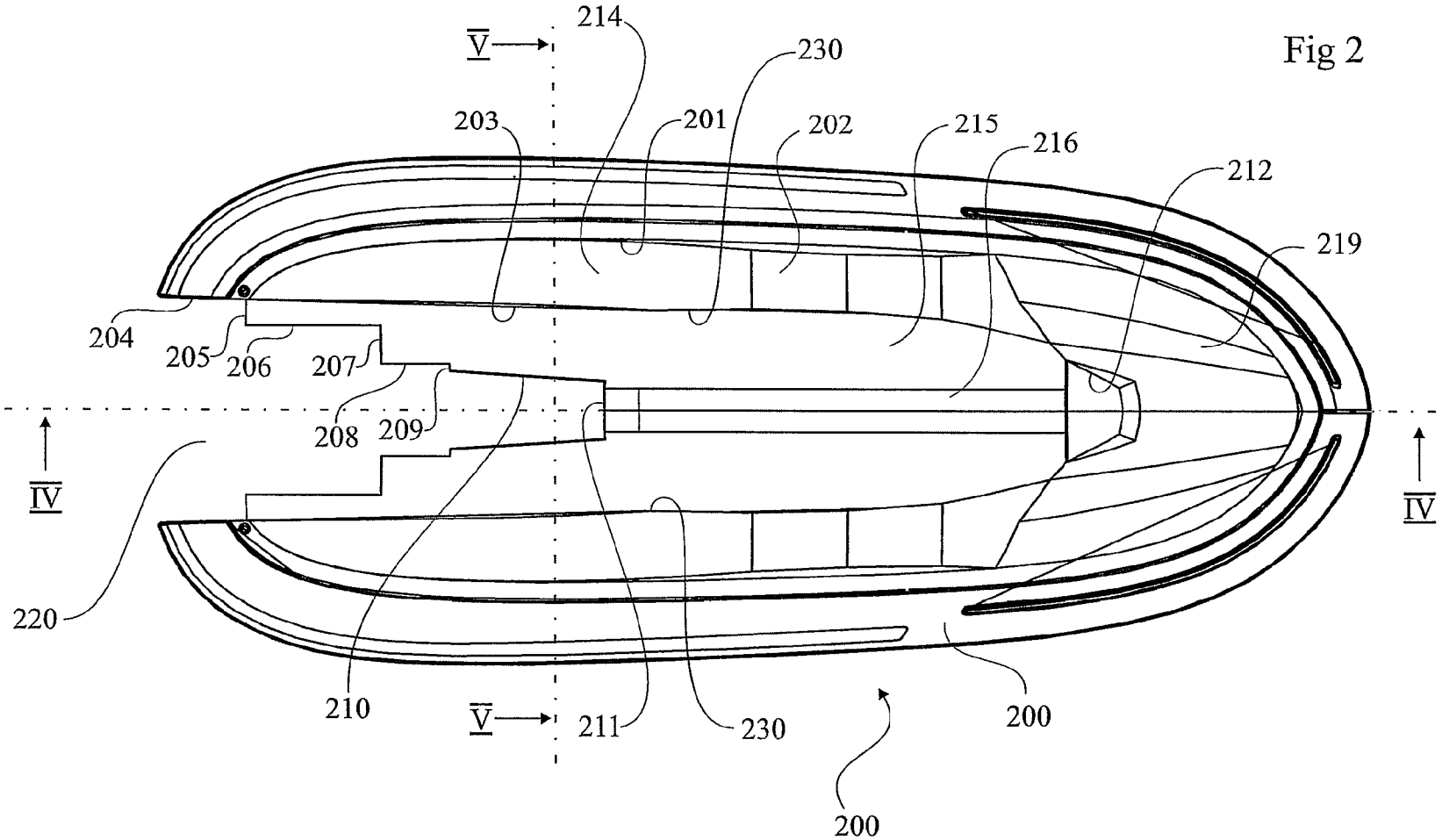
FIG. 2 shows a hull unit of the vessel shown in FIG. 1.

In FIG. 2 there is shown a view from above of the hull unit 200. As can be seen the central portion 200A is substantially wider than each one of the side portions 200B, 200C. Moreover it is shown that each side portion 200B, 200C extends along the outer periphery of the central portion 200A from the front along the periphery of each side and around the rear corner. The rear ends 204 of the side portions 200B, 200C are positioned to leave a substantial gap between them at the rear of the vessel, providing space for the water jet in the propulsion unit 100. The central portion 200A is arranged with a number of edges 205, 207, 209, 211 positioned stepwise from the rear end, in a direction towards the centre, to form a stepwise narrowing open space 220 adapted to the configuration of the propulsion unit 100. This space 220 opens up into the rear end bottom area 215, 216, 250 of the central portion 200A. The configuration of the upper surfaces 215, 216 of the bottom area is shaped to correspond to the shape of the corresponding outer surfaces of the propulsion unit 100 to provide contact between the propulsion unit 100 and the upper bottom surfaces 215, 216 of the central portion 200A, thereby providing for stability/rigidity of the vessel.

Figure 4:
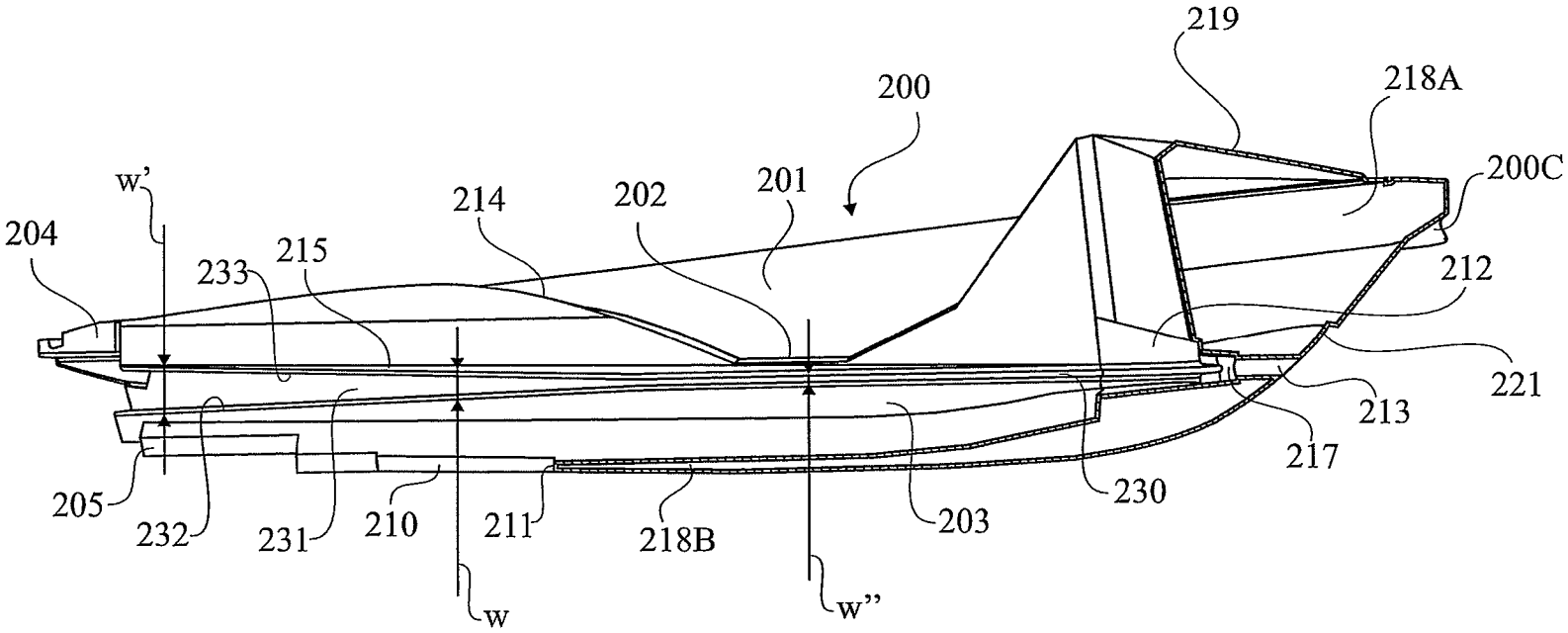
FIG. 4 shows a cross-sectional view along line IV-IV in FIG. 2.

As shown in FIG. 4 there is sealed space 218B between the upper surfaces, e.g. 215, 216 and the lower surfaces, to provide buoyancy. At the front of the central portion 200A there is provided a top deck surface 219, which forms the upper sealing layer of the central portion 200A and which together with the design of the front of the central portion 200A encloses a substantial portion of the totally enclosed volume 218A, 218B of the central portion 200A. Preferably the enclosed volume 218A within this portion of the central portion 200A is in the range of 40%-70% of the total volume within the central portion 200A, preferably more than 50% (see also FIG. 4), to provide a sufficient amount of buoyancy to allow the vessel to be lifted up in the water also when hitting large waves, i.e. to not risk to have the vessel diving into big waves. Moreover there is an advantage in that design also from the aspect of being able to use the vessel to run ashore, or to be able to hit the hard object. The flexible, resilient material of the front wall 21, in combination with the large enclosed "gas volume" 218A provides for good resiliency which enables the vessel to withstand hitting hard objects, e.g. in conjunction with running ashore. In the transition area between the bottom surfaces 215, 216 and the front there is provided a delimited space formed by forwardly converging side walls 212. As can be seen in FIG. 4 this delimited space is at its front wall arranged with a through hole 213, 217. Further, FIGS. 2 and 4 present that there is a transition area 203 along each side of the central portion 200A, which transition area joins the bottom are 215, 216 with the side walls. At the upper termination of this side wall 203 there is positioned an interlocking device 230 that extends all the way from the area of the most rearward edge 205 on one side to the other one of the other side.

Figure 5:
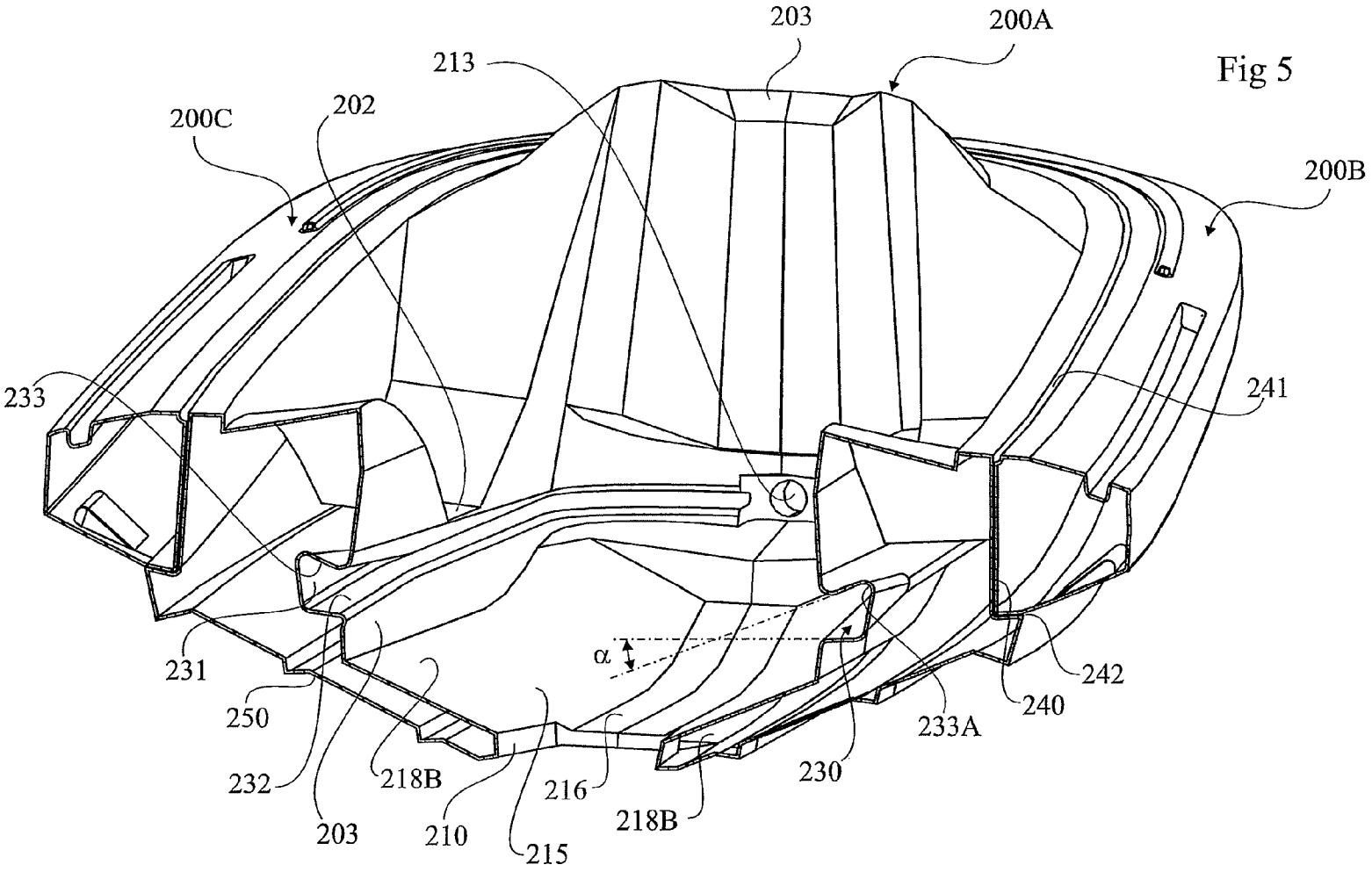
FIG. 5 shows a cross-sectional view along line V-V in FIG. 2.
Figure 6:
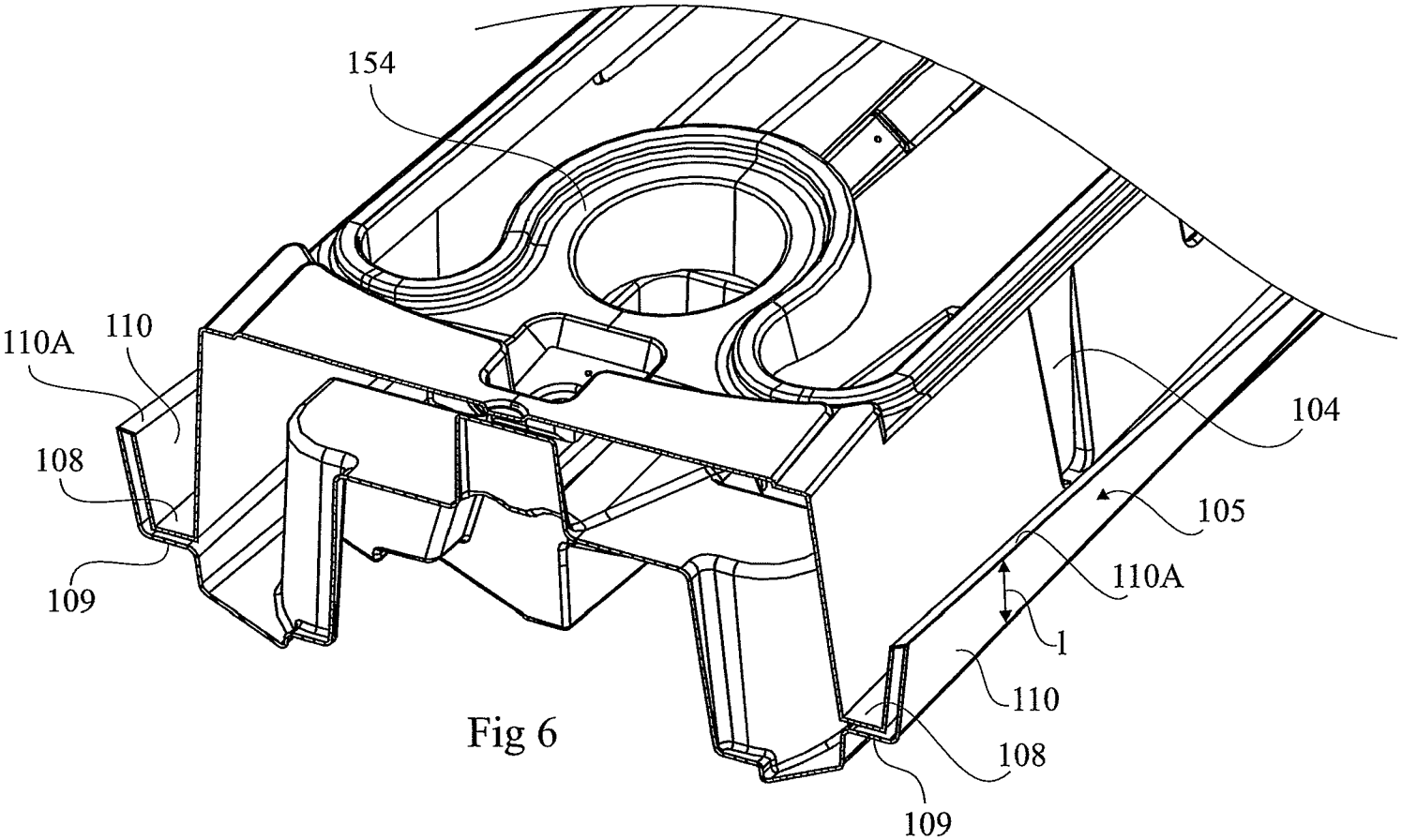
FIG. 6 shows a cross-sectional view along line VI-VI in FIG. 3.

In FIGS. 4 and 5 there is shown that the interlocking device 230 is in the shape of recess having a bottom wall 232, a side wall 231 and a top wall 233. The width w of the recess, i.e. the distance between bottom wall 231 and the top wall 233 is widest at the rear end w' and continuously decreases to reach a constant width w" at about the middle of the total longitudinal extension of the recess 230. Preferably the width w' at the rear end is at least double the width w' at the front portion according to the shown embodiment the maximum width w' is about 100 mm and the constant width w" about 20 mm. Moreover it is shown in FIG. 5 that the top wall 233 is inclined to form an angle $\alpha$ in relation to the extension of the plane of the bottom wall 232, making the recess wedge-shaped in a vertical cross-sectional, i.e. creating a wedge-shaped corner area 233A. Thanks to this wedge-shaped design of the recess 230 an interfitting portion of the propulsion unit 100 having a corresponding shape will be retained therein hindering the sides of the hull unit 100 to move out of contact with the propulsion unit 100A, once in position. Further the design of the recess 230 allows for having the propulsion unit slid into the hull unit 200 from the behind to safely engage the two units 100, 200, and moreover the design is such that it does not totally seal between the flange 105 and the recess 230, but assist in self-bailing of water from the foot rest area 202.

FIG. 5 further shows that the central portion 200A at its side periphery is arranged with an L-shaped outwardly extending area 240 and that each side portion 200A, 200B is arranged with a corresponding L-shape to fit into, and be supported by the central portion 200A. By means of welds 241, 242 the side portions 200B, 200C, basically functioning as fenders which at the same time forms the hull, are fixedly attached to the central portion 200A. Thus, the hull unit (100) comprises a central portion (200A) being provided with a non-straight lined area (240) arranged to support and position said at least one further portion (200B, 200C).

In FIGS. 3, 6, 7 and 8 there are shown details of the propulsion unit 100. The propulsion unit 100 is made in a material that is less flexible, i.e. more rigid, than the material used in the hull unit 200. Accordingly the propulsion unit 100 provides for the stability/rigidity of the whole vessel. Indeed, thanks to the rigid design of the propulsion unit 100 the vessel 100, 200 is strong enough to be transported by a helicopter in high speed, e.g. hanging underneath the helicopter at a speed of up to 88 knots. The preferred material used in at least major parts of the propulsion unit 100 is some kind of composite material, e.g. a curable resin having fibre reinforcement. A suitable material is any traditional kind of fibre and curable resin, e.g. glass fibre and polystyrene or polyester, used frequently for production of hull structures to smaller boats/vessels. As already explained the inner space 150 of the propulsion unit 100 is intended for the drive unit (not shown), which is fitted therein in a manner known per se and will therefore not be described more in detail. Further as mentioned the propulsion unit 100 is intended to provide stability to the vessel, e.g. to enable lifting of the vessel without breaking. In this context the inner side walls 102 and the outer side walls 101 are sufficiently reinforced to withstand the forces that are produced when lifting the vessel and/or when riding the vessel in any situation that it is intended to withstand. Further to provide extra stability the space intermediate inner wall 102 and the outer wall 101 is provided with stabilising wall material 120, e.g. a foam material such as divinicell. At the position 104 there are shown recesses 104 formed at the outer sides of the propulsion unit 100, at and around the upper edge, to provide attachment for a casing comprising electrical details of the vessel, e.g. generator. Further, there is shown that in front of said casing there is indicated positioning of a sealed box 400 containing the electric control system, which is shown in more detail in FIG. 8.

Figure 3:
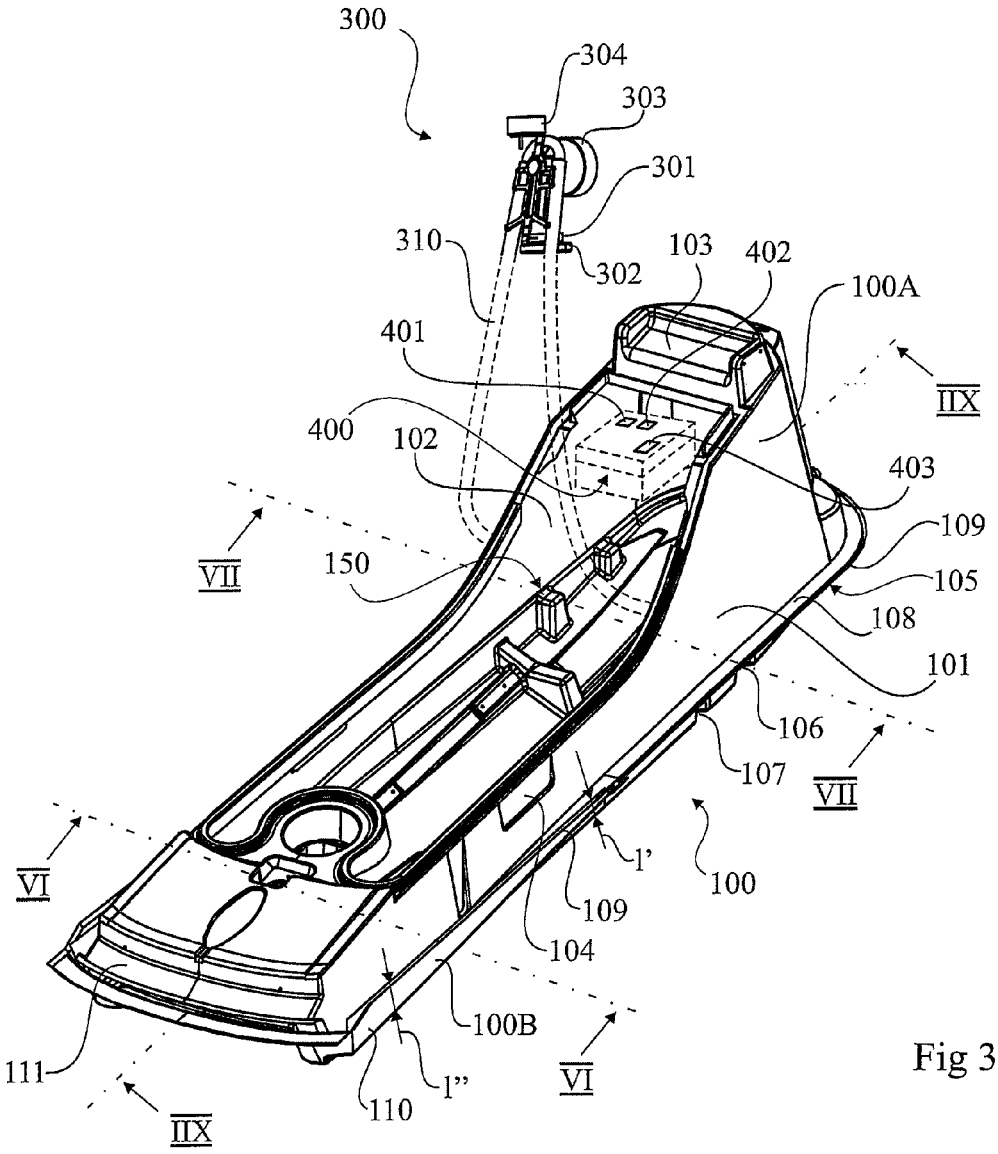
FIG. 3 shows a propulsion unit in a perspective view seen from behind and above of the vessel shown in FIG. 1.

Further FIG. 3 schematically presents that there is a support device 300, which comprises a generally U-shaped mounting 310, which end-pieces are attached to the propulsion unit 100 (not shown) and onto which, at the top, there are arranged accessories/equipment 301-304. Among other things there is shown a navigation/position light 301, a bumper device (e.g. rubber foam) 302 fixed onto the bottom of the position light 301, a handheld torch 303 and a flash-lamp 304. The flash-lamp 304 is especially designed to be compact and to require relatively low power, by means of using a blue flash-lamp. To be easily detectable from the sky the flash-lamp 304 has a cover that is transparent upwardly, and of course also at the sides to be detectible by other boats. The torch 303 is realisably attached to the mounting 310 by means of suitable means (e.g. resilient ribbons, not shown). Accordingly the torch 303 may be used in a flexible manner to try to find people in need. Preferably the torch has a high power output, to provide excellent luminance, and therefore the switch (at the handle) of the torch 303 is preferably connected to the electric control unit 400 in such a manner that when the torch is lit other power consuming functions, e.g. heating of handles and/or under water light, will be turned off, to household with the power supply.

Further, as is indicated in FIG. 3, the electric control unit 400, at its top, is arranged with at least one switch 401, 402. Preferably there is one switch 401 to control high or low heat for the handles and one switch 402 to facilitate emergency activation of the blue flash-lamp 304 and/or an AIS-transponder. Moreover there is a transparent portion 403, also arranged in the upper wall (e.g. the lid) of the sealed box 400, by means of which certain elements within the sealed box 400 may easily be visually supervised/checked up on.

Extending along the sides and around the front of the propulsion unit 100, adjacent the lower part thereof, there is a flange 105 forming the interlocking device intended to interlock with the recess 230 of the hull unit 200. The flange 105 has a top surface 108, belonging to an intermediate portion 100A, and bottom surface 109, belonging to a bottom portion 100B, which are rigidly connected to each other. Hence, the flange 105 is formed in the joint between these two portions 100A, 100B and extends from adjacent the aft III of the propulsion unit 100 all the way around the front to the other side. Along a substantial portion, from the aft to about the middle of the flange 205, on each side, there are arranged interlocking extensions 110, which extensions present continuously increasing length l closer to the aft of the propulsion unit. Accordingly the length l' close to the middle of the propulsion unit 100 is smaller than the length l" at the rear of the propulsion unit. The edge area 110A of the interlocking extension 110 will interlock into the wedge-shaped corner area 233A of the wedge-shaped recess 230 and the bottom surface 109 of the flange 105 will assist in the interlocking action by interacting with the lower wall 232 of the recess 230. Accordingly the design of the flange 105, having interlocking extensions 110, will safeguard that the hull portion 200 will safely interlock onto the propulsion unit 100 once the two units have been slid into contact with each other. Thanks to the propulsion unit 100 pushing into the hull unit 200 during propulsion there is no big need for any securing attachments, especially considering that friction forces within the interlocking devices 230, 105 will assist to keep the units in position. However there are arranged through-holes (see adjacent edge 205 in FIG. 2) in the hull portion 200 and the propulsion unit 100 to fix them in interlocked positions, by means of pins (not shown).

Figure 7:
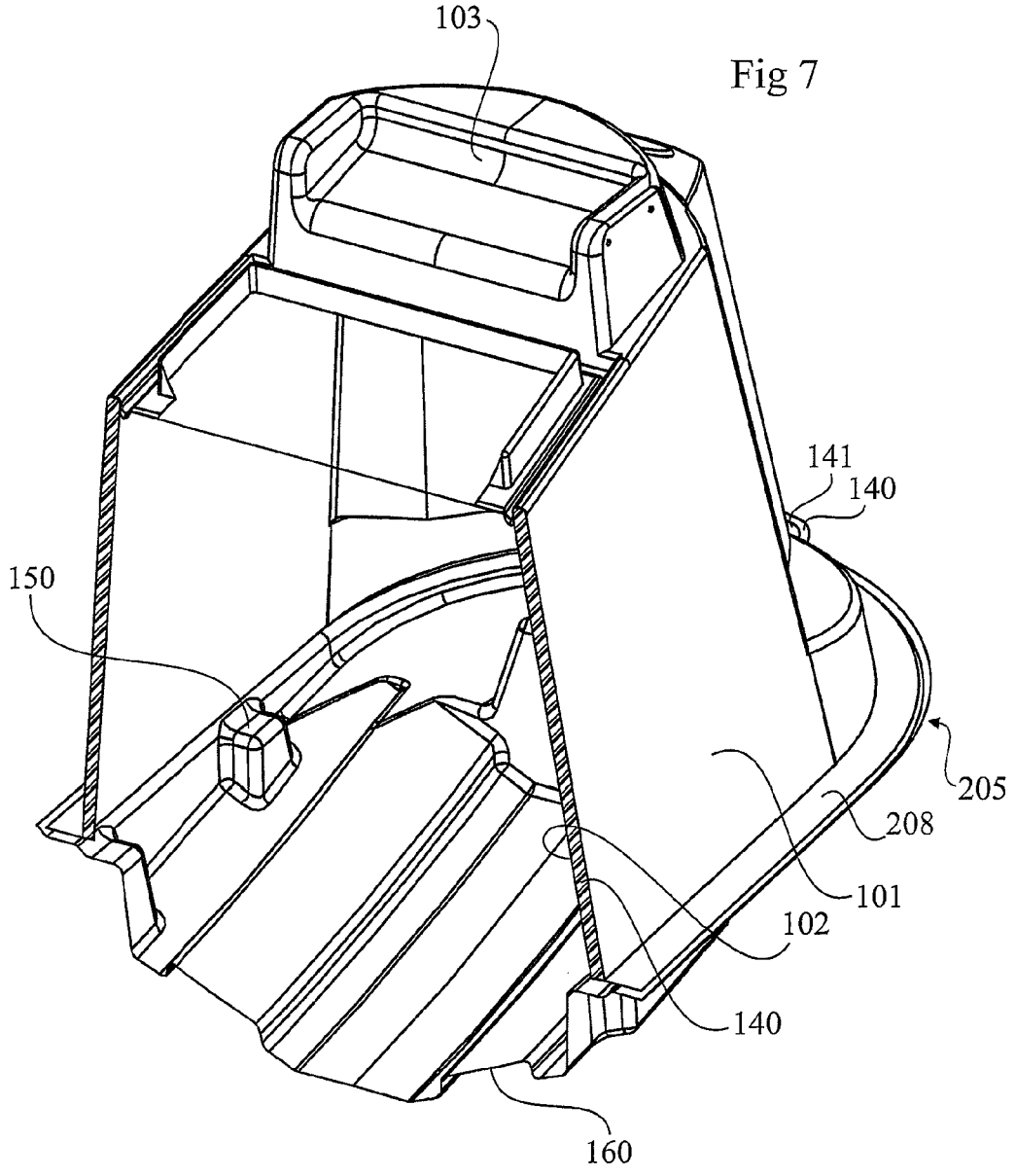
FIG. 7 shows a cross-sectional view along line VII-VII in FIG. 3, and, FIG. 8 shows a perspective view of an electrical control unit in accordance with a preferred embodiment of the invention.

Further FIG. 7 presents a protruding portion 140 of the flange 205, at the front end of the propulsion unit 100. The protruding portion is arranged with a through hole 141, intended for fixing of a rope (not shown). The rope is intended to pass out through the hull portion 200 by means of a through hole 217, 213, to have the rope of the vessel securely fixed to the rigid propulsion unit 100. Moreover there is shown a longitudinally extending channel 160, the purpose of which is to provide extra stability/strength and to provide space for attachments for tank, engine, etc.

Figure 8:
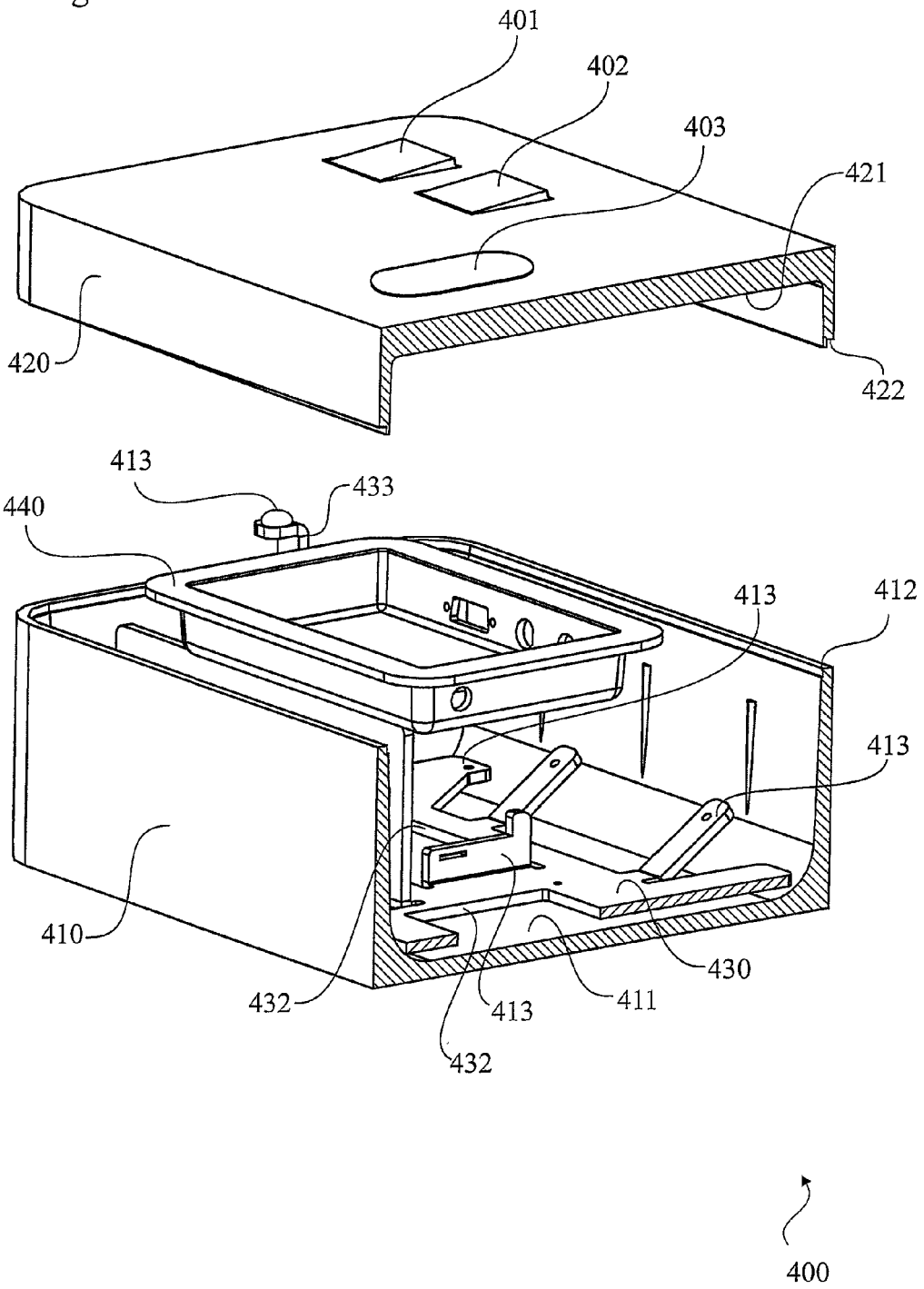

In FIG. 8 there is a figure showing some principles of the electrical control unit arrangement 400. All of the electrical components (not shown) are encased within a sealed box comprising a box portion 410 and a lid portion 420. These two portions 410, 420 are designed such that when their opposing edges 422, 412 enter into contact they will seal and retain the portions 410, 420 together. In an alternative embodiment (not shown) the lid 420 is arranged by means of hinges along one side of the box portion 410 and an easy assessable locking handle being used to close and open the lid 420 respectively.

All the electrical components (not shown) are securely attached to a frame unit 430 (e.g. a punched out and folded metal plate) presenting a number of different support structures 431 and a number of openings 432 to fixedly hold the different components in desired positions. The position are chosen such that it will be easy to install each component and also to repair/perform maintenance. In a preferred embodiment the support structure 430 is not fixedly attached to the box 400, but is squeezed into a fixed position between the bottom surface 411 of the box portion 410 and the inner surface 421 of the lid portion 420. This is achieved by having the support structure 430 arranged with a lower face being in stable contact with the bottom surface 411 and at least two upwardly protruding parts 433 of the support structure 430, each being arranged with a resilient knob device 430 at the top, such that when the lid portion 420 is in its closed position it will press the support structure 430 via the resilient knobs 413 into firm contact with the bottom surface 411 of the box portion 410. Further there is shown a separate, tray formed, device 440, which is adapted to contain an AIS-transponder, which tray 440 may be attached to the inner surface 421 of the lid portion 420. Further the box 400 preferably contains a separate battery for emergency power to said AIS-transponder and/or the flash lamp 304.

Not shown in the figures is a beneficial design of the antenna that is being used, which is a wishbone-construction that uses a frictional device to be collapsed. Another aspect that is not directly shown in the figures is the use of a lid on the top of the opening 154 in the propulsion unit 100 that facilitates quick and easy access to the water jet, e.g. to remove undesired objects.

The invention is not limited by the embodiment described above but may be varied within the scope of the appended claims. For instance, it is evident that the skilled person may find many different kind of materials that may be combined in a obvious manner to produce desired properties, e.g. depending on various differing needs of the vessel being produced, e.g. if intended to be used in a sea normally having large waves or if used in a lake normally having smaller waves. Moreover it is understood that the exact shape of the interlocking recess of the hull unit and the interlocking flange device 205 of the propulsion unit may be formed in many various altering shapes, but still producing the same kind of function, i.e. safeguarding the hull unit 200 of a more flexible material to be safely attached to the rigid propulsion unit 100. For instance it is evident that the creation of flange device 105 having a cross-section that totally corresponds to the cross-section of the recess is an evident option, which may be desired if increased strength is desired. However in most applications the use of an interlocking extension 110 is sufficient and therefore preferable due to being more cost efficient. Further it is evident that the design may easily be adapted to use of different kind of driving unit than the one presented in the shown embodiment, and that indeed in some applications another kind of driving unit may be desired.

The invention claimed is:

1. A naval rescue vessel comprising:

a propulsion unit powered by a water jet;

a hull unit; and an interconnection, wherein said hull unit is at least partly flexible, and wherein said propulsion unit is arranged to form a rigid unit, and wherein said hull unit and said propulsion unit are interconnected by said interconnection to form said naval rescue vessel which is constructed and arranged to be handled or maneuvered by a single rescuer, and wherein said interconnection is arranged to provide a releasable connection of the units, said hull unit is at least partly flexible, said hull unit comprises a central portion with upper bottom surfaces shaped to correspond to the shape of a corresponding outer surface of said propulsion unit to provide contact between the propulsion unit and the upper bottom surfaces when interconnected to form a naval rescue vessel and thereby providing for stability/rigidity of the vessel, wherein said interconnection comprises a flange device on one of the units and a recess device on the other unit, said recess device at least partly presents a wedge shaped cross-sectional area and that said flange device presents an interlocking means arranged to interlock within said wedge shaped cross-sectional area, and the interlocking means does not extend along all of said flange device.

2. A naval rescue vessel according to claim 1, wherein the flange device is arranged on the propulsion unit.

3. A naval rescue vessel according to claim 1, wherein said hull unit comprises at least one portion sealingly enclosing an inner space providing buoyancy.

4. A naval rescue vessel according to claim 3, wherein said hull unit comprises at least two portions, each one sealingly enclosing an individual volume.

5. A naval rescue vessel according to claim 4, wherein said portions are fixedly attached to each other by means of welds.

6. A naval rescue vessel according to claim 3, wherein said hull unit comprises a central portion being provided with a non-straight lined area arranged to support and position said at least one portion.

7. A naval rescue vessel according to claim 3, wherein said hull unit comprises at least three portions, each one sealingly enclosing an individual volume.

8. A naval rescue vessel according to claim 1, wherein said propulsion unit is arranged with a rope attachment shielded by the hull unit and that said hull unit is provided with a through hole for a rope.

9. A naval rescue vessel according to claim 1, wherein said propulsion unit is arranged with an open able, sealable box including essential electrical components for operation of equipment mounted on the vessel, and wherein said components are fixed onto a support structure that is arranged easy release able within in said box.

* * * * *